US011980998B2

(12) United States Patent
Kobata et al.

(10) Patent No.: US 11,980,998 B2
(45) Date of Patent: May 14, 2024

(54) POLISHING DEVICE, POLISHING METHOD, AND RECORDING MEDIUM FOR RECORDING PROGRAM FOR DETERMINING SUPPLY POSITION OF POLISHING LIQUID

(71) Applicant: EBARA CORPORATION, Tokyo (JP)

(72) Inventors: Itsuki Kobata, Tokyo (JP); Takashi Yamazaki, Tokyo (JP); Ryuichi Kosuge, Tokyo (JP); Tadakazu Sone, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 1072 days.

(21) Appl. No.: 16/796,903

(22) Filed: Feb. 20, 2020

(65) Prior Publication Data

US 2020/0269385 A1 Aug. 27, 2020

(30) Foreign Application Priority Data

Feb. 21, 2019 (JP) ..... 2019-029543

(51) Int. Cl.
*B24B 57/02* (2006.01)
*B24B 37/005* (2012.01)
(Continued)

(52) U.S. Cl.
CPC ..... *B24B 57/02* (2013.01); *B24B 37/005* (2013.01); *B24B 37/34* (2013.01); *B24B 55/02* (2013.01); *B24D 13/147* (2013.01); *B24D 13/20* (2013.01)

(58) Field of Classification Search
CPC ..... B24D 13/20; B24D 13/147; B24B 55/02; B24B 37/34; B24B 37/005; B24B 57/02
(Continued)

(56) References Cited

U.S. PATENT DOCUMENTS

2002/0195424 A1 12/2002 Tanaka
2004/0166686 A1 8/2004 Lin et al.
(Continued)

FOREIGN PATENT DOCUMENTS

JP 2003001559 1/2003
JP 2008093742 4/2008
JP 2010247258 11/2010

*Primary Examiner* — Joel D Crandall
*Assistant Examiner* — Shantese L Mcdonald
(74) *Attorney, Agent, or Firm* — JCIPRNET

(57) ABSTRACT

An operation control unit includes a storage device storing a program which includes commands of: obtaining a correlation between a supply position of the polishing liquid in the radial direction of the polishing pad using the liquid injection nozzle and an average polishing rate of the substrate and an distribution of the polishing rate within the substrate; determining a movable range of the liquid injection nozzle according to a predetermined range of an allowable average polishing rate and the correlation between the supply position of the polishing liquid and the average polishing rate; determining an optimal supply position of the polishing liquid from the correlation between the supply position of the polishing liquid and the distribution of the polishing rate within the substrate within the determined movable range of the liquid injection nozzle; and moving the liquid injection nozzle to the determined supply position to polish the substrate.

12 Claims, 12 Drawing Sheets

(51) Int. Cl.

| | |
|---|---|
| ***B24B 37/34*** | (2012.01) |
| ***B24B 55/02*** | (2006.01) |
| ***B24D 13/14*** | (2006.01) |
| ***B24D 13/20*** | (2006.01) |

(58) Field of Classification Search
USPC ..... 451/36, 5, 28, 41
See application file for complete search history.

(56) References Cited

U.S. PATENT DOCUMENTS

| | | | | |
|---|---|---|---|---|
| 2006/0027533 | A1 | 2/2006 | Leng | |
| 2006/0105678 | A1 | 5/2006 | Kohama et al. | |
| 2010/0255756 | A1* | 10/2010 | Ishii | B24B 57/02 451/28 |

* cited by examiner (a)

(b)

(a)

(b)

(a)

(b)

POLISHING DEVICE, POLISHING METHOD, AND RECORDING MEDIUM FOR RECORDING PROGRAM FOR DETERMINING SUPPLY POSITION OF POLISHING LIQUID

CROSS-REFERENCE TO RELATED APPLICATION

This application claims the priority of Japan patent application serial no. 2019-029543, filed on Feb. 21, 2019. The entirety of the above-mentioned patent application is hereby incorporated by reference herein and made a part of this specification.

BACKGROUND

Technical Field

The disclosure relates to a polishing device, a polishing method for polishing a substrate such as a wafer, and a recording medium in which a program for determining a position for supplying a polishing liquid is recorded.

Description of Related Art

In a manufacturing process of a semiconductor device, planarization techniques for surfaces of a device have become increasingly important. The most important technique of the planarization techniques is chemical mechanical polishing (hereinafter referred to as CMP). The CMP uses a polishing device to perform polishing by bringing a substrate such as a wafer into sliding contact with a polishing surface while supplying a polishing liquid (slurry) containing abrasive such as silica ($SiO_2$) and ceria ($CeO_2$) to a polishing pad.

A polishing device including a polishing liquid supply nozzle (a single tube nozzle) for supplying a polishing liquid (slurry) onto a polishing pad is known (for example, see Patent Document 2, Japanese Patent Application Laid-Open No. 2010-247258). In such a polishing device, a substrate is polished while the polishing liquid is supplied from the polishing liquid supply nozzle onto the polishing pad.

[Patent Document 1] Japanese Patent Application Laid-Open No. 2003-1559

A polishing rate of a substrate depends on a distribution in a flow rate of a polishing liquid. Therefore, it is very important to control a supply position of a polishing liquid on a substrate in order to improve uniformity of a polishing rate within a substrate. However, a polishing liquid supply nozzle, which is a single tube nozzle, locally supplies a polishing liquid to a narrow region on a polishing pad. Therefore, when such a polishing liquid supply nozzle is used, a distribution in a flow rate of the polishing liquid at the supply position becomes large on a surface of the polishing pad. This becomes a factor that causes large distribution in a polishing rate within a substrate.

In addition, in the case of supplying a polishing liquid at a fixed position, if the polishing liquid is supplied to an outer peripheral side of a polishing pad, a large amount of polishing liquid is discharged to the outside of the polishing pad, and thus a polishing rate within a substrate decreases. Therefore, a polishing liquid supply nozzle is required to swing during polishing within a substrate, but a polishing table supporting a polishing pad rotates during polishing within a substrate. Therefore, distribution in supply positions of the polishing liquid in a radial direction of the substrate does not become uniform in a circumferential direction of the polishing pad.

SUMMARY

According to one aspect of the embodiment, a polishing device is provided. The polishing device includes a polishing pad, a top ring which presses a substrate against the polishing pad to polish the substrate, a liquid injection nozzle which injects a polishing liquid in a fan shape on the polishing pad, a nozzle moving device which moves the liquid injection nozzle in a radial direction of the polishing pad, and an operation control unit which controls an operation of the nozzle moving device. The operation control unit includes a storage device which stores a program, and a processing device which performs a calculation in accordance with the program. The program includes commands of: obtaining a correlation between a supply position of the polishing liquid in the radial direction of the polishing pad using the liquid injection nozzle and an average polishing rate of the substrate and an distribution of the polishing rate within the substrate; determining a movable range of the liquid injection nozzle on the basis of a predetermined range of an allowable average polishing rate and the correlation between the supply position of the polishing liquid and the average polishing rate; determining an optimal supply position of the polishing liquid from the correlation between the supply position of the polishing liquid and the distribution of the polishing rate within the substrate within the determined movable range of the liquid injection nozzle; and moving the liquid injection nozzle to the determined supply position to polish the substrate.

According to one aspect of the embodiment, a polishing method is provided. The polishing method includes obtaining a correlation between a supply position of a polishing liquid in a radial direction of a polishing pad using a liquid injection nozzle which injects the polishing liquid onto the polishing pad in a fan shape and an average polishing rate of a substrate and an distribution of a polishing rate within the substrate, determining a movable range of the liquid injection nozzle from a predetermined range of an allowable average polishing rate and the correlation between the supply position of the polishing liquid and the average polishing rate, determining an optimal supply position of the polishing liquid from the correlation between the supply position of the polishing liquid and the distribution of the polishing rate within the substrate within the determined movable range of the liquid injection nozzle, and moving the liquid injection nozzle to the determined supply position to polish the substrate.

According to one aspect of the embodiment, a non-transitory computer-readable recording medium for recording a program is provided. The program causes a computer to execute steps of: obtaining a correlation between a supply position of a polishing liquid in a radial direction of a polishing pad using a liquid injection nozzle which injects the polishing liquid onto the polishing pad in a fan shape and an average polishing rate of a substrate and an distribution of a polishing rate within the substrate; determining a movable range of the liquid injection nozzle from a predetermined range of an allowable average polishing rate and the correlation between the supply position of the polishing liquid and the average polishing rate; determining an optimal supply position of the polishing liquid from the correlation between the supply position of the polishing liquid and the distribution of the polishing rate within the substrate within the determined movable range of the liquid injection nozzle; and moving the liquid injection nozzle to the determined supply position to polish the substrate.

Figure 1:
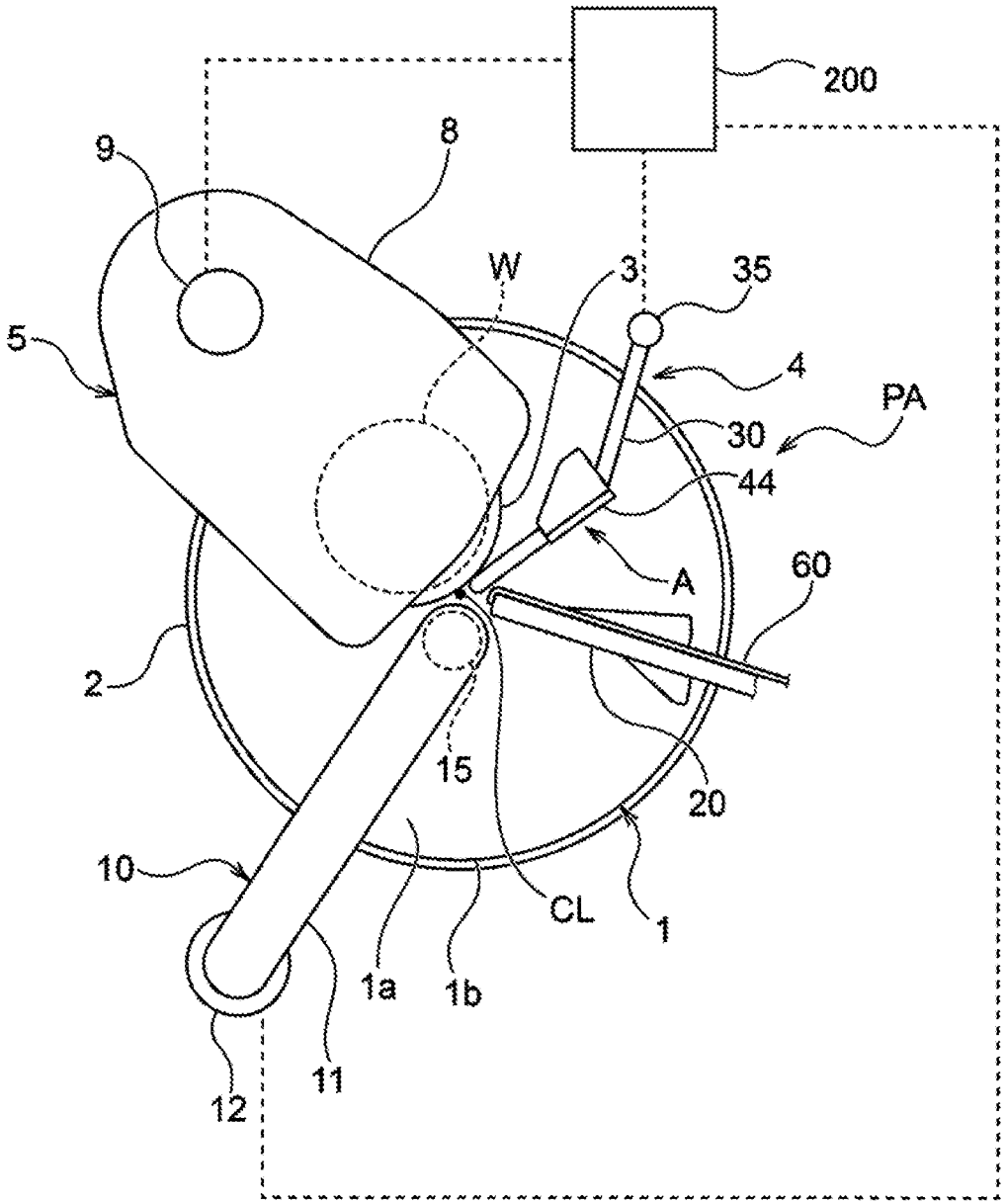
FIG. 1 is a plan view of one embodiment of a polishing device.
Figure 2:
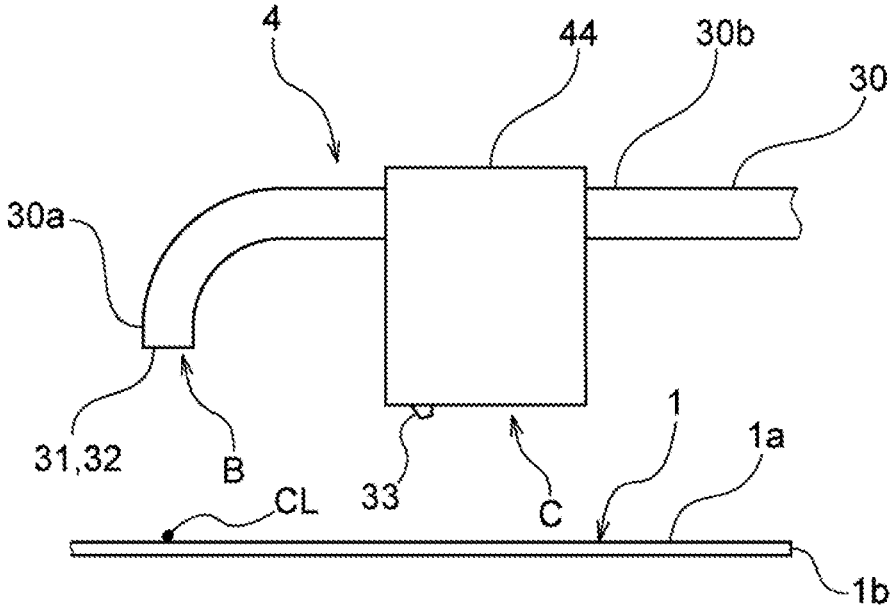
Figure 2:
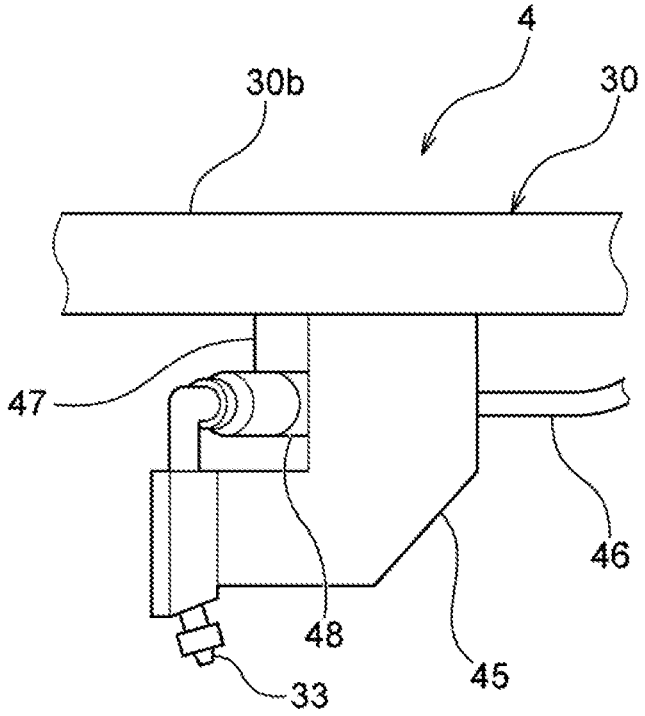

Part (a) of FIG. 2 is a diagram viewed in a direction of line A of FIG. 1, and part (b) of FIG. 2 is a diagram showing a state in which a cover of part (a) of FIG. 2 is removed.

Figure 3:
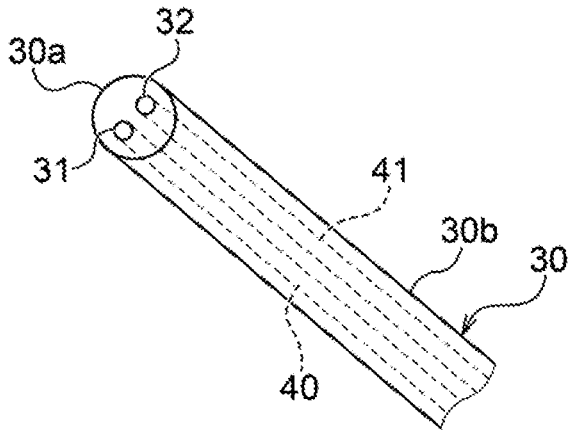
Figure 3:
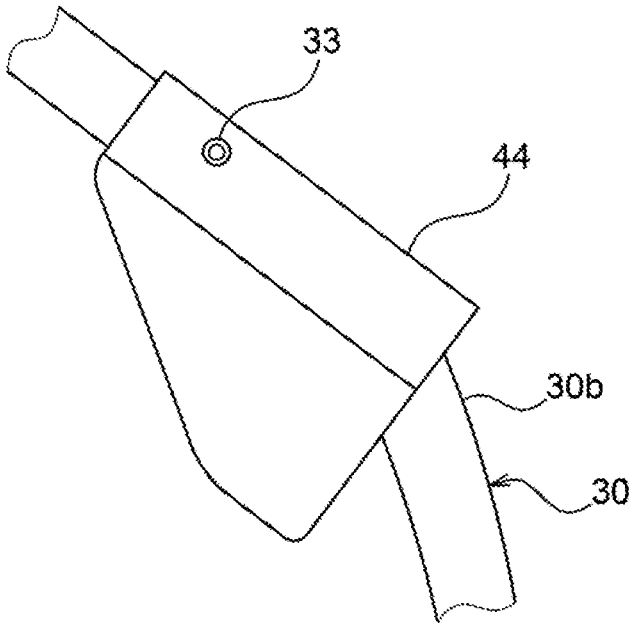

Part (a) of FIG. 3 is a diagram viewed in a direction of line B of part (a) of FIG. 2, and part (b) of FIG. 3 is a diagram viewed in a direction of line C of part (a) of FIG. 2.

Figure 4:
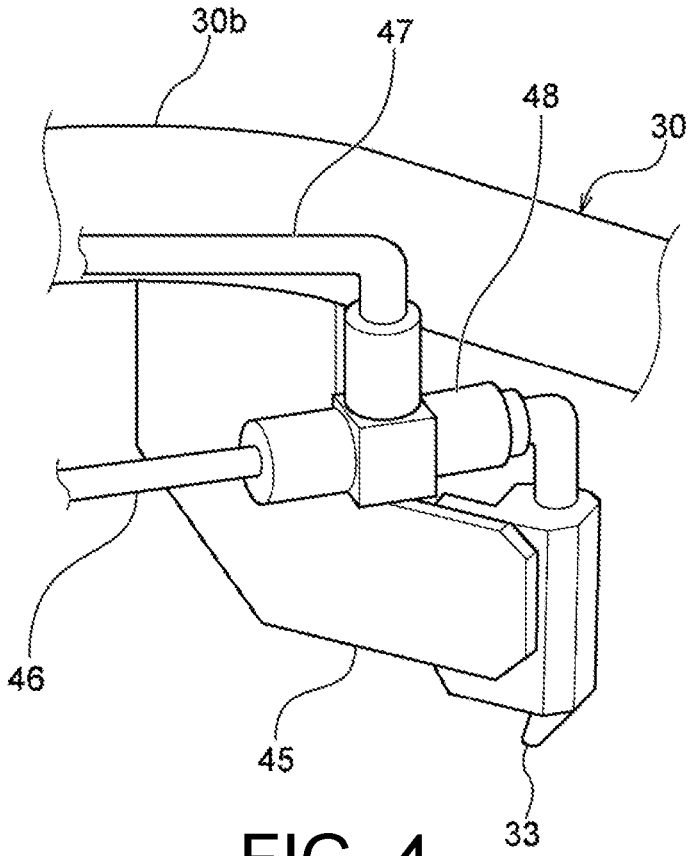

FIG. 4 is a diagram showing a third slurry line (a third liquid supply line) and a flushing line that are connected to a liquid injection nozzle.

Figure 5:
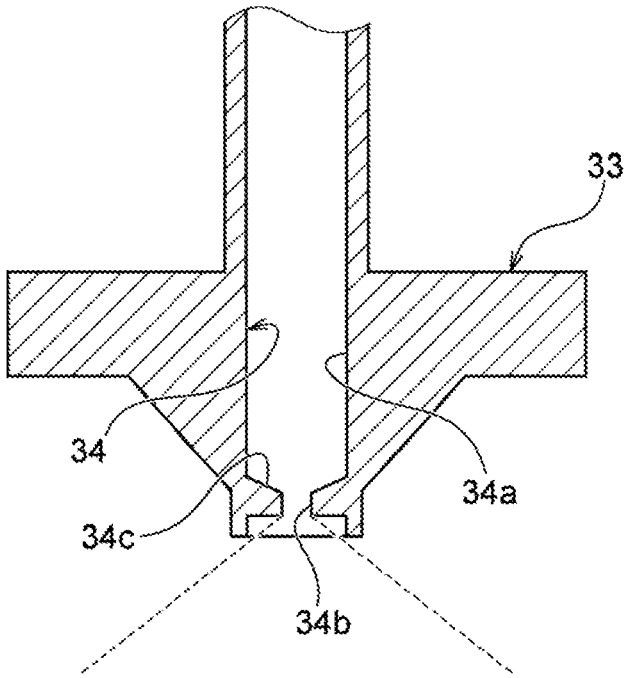

FIG. 5 is a cross-sectional view showing the liquid injection nozzle.

Figure 6:
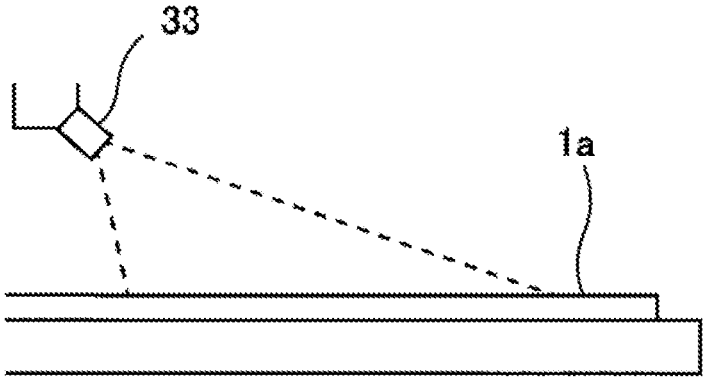

FIG. 6 is a diagram showing an injection range of slurry.

Figure 7:
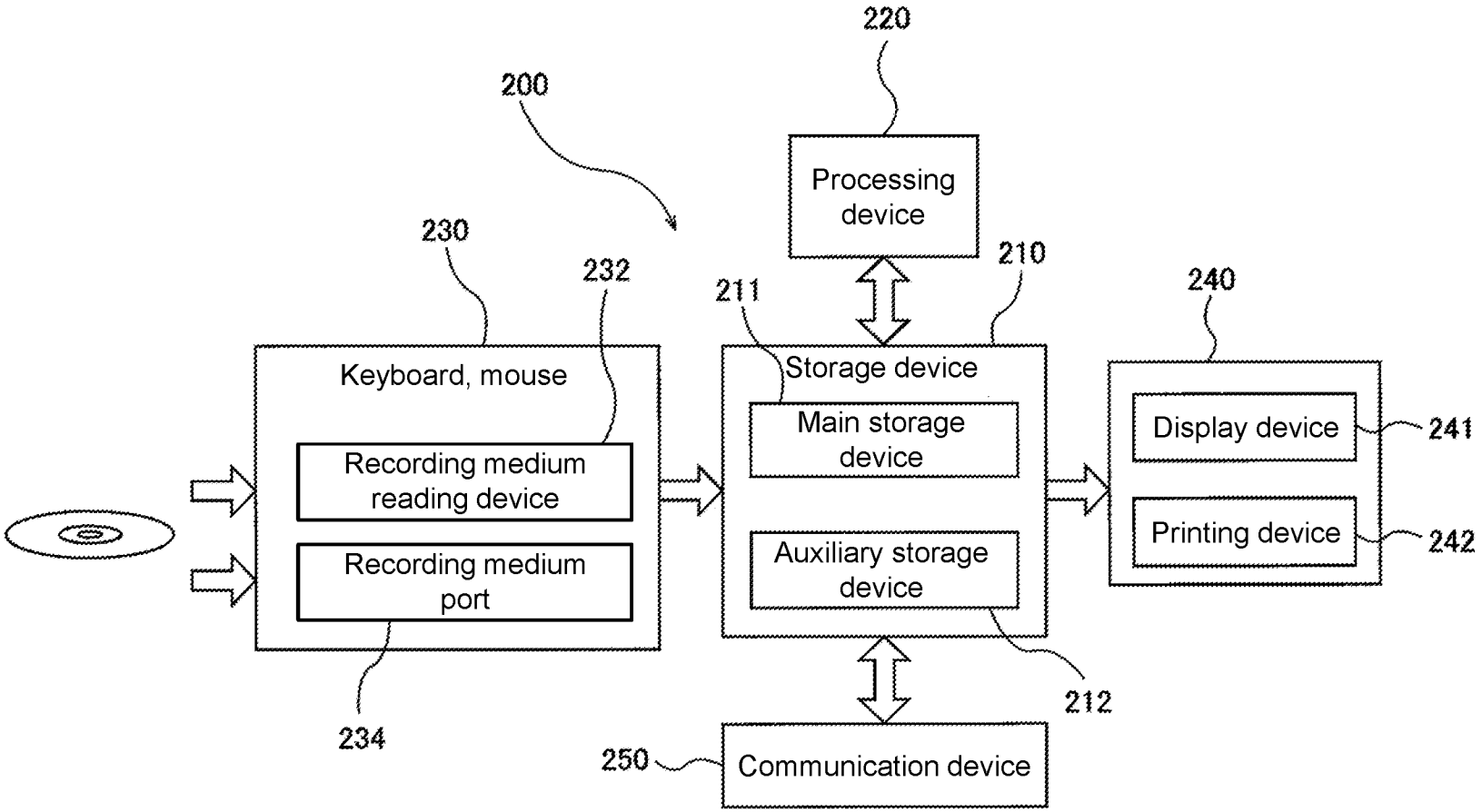

FIG. 7 is a schematic diagram showing a configuration of an operation control unit.

Figure 8:
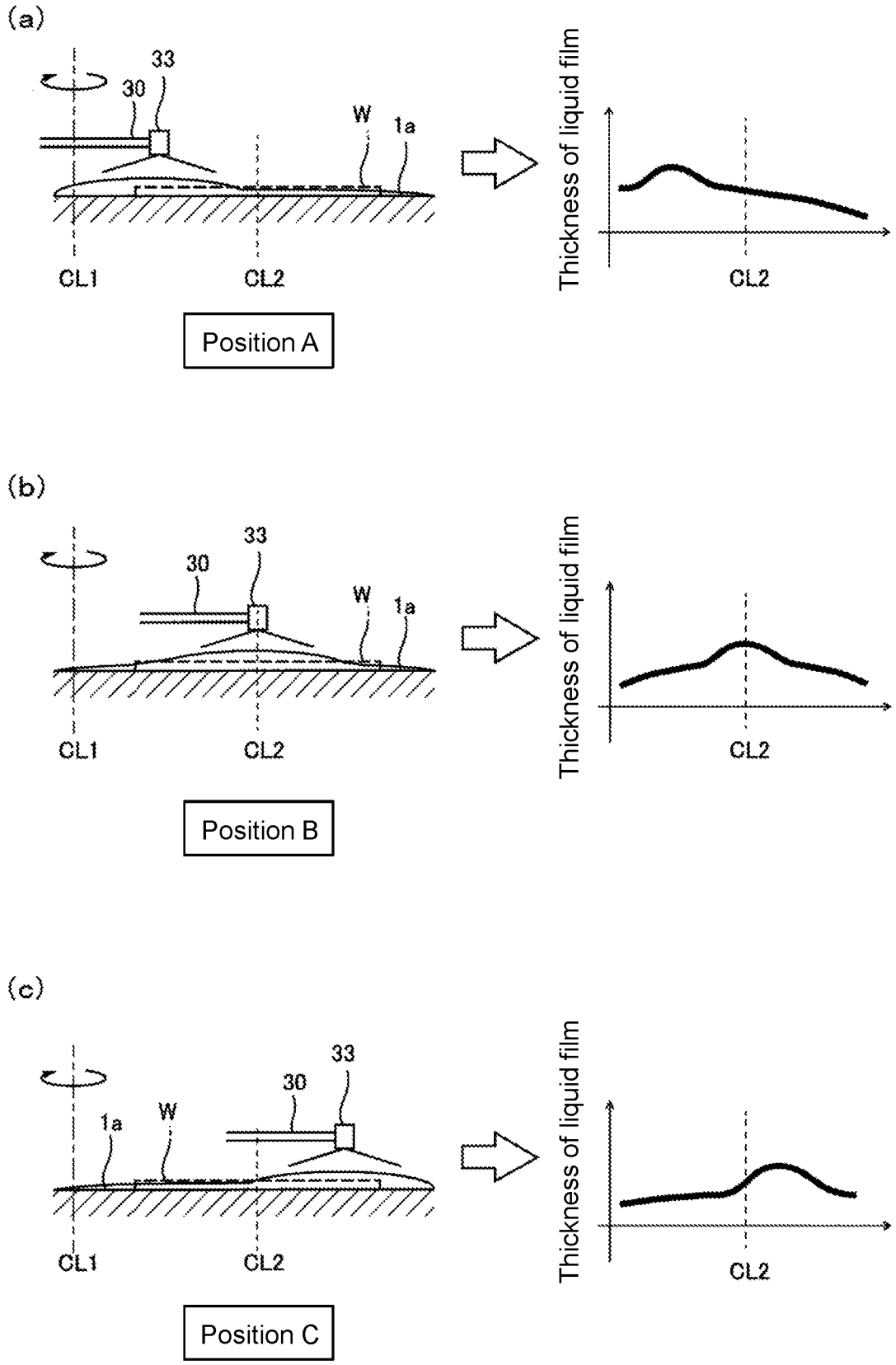

Parts (a) to (c) of FIG. 8 are diagrams showing a relationship between a supply position of a polishing liquid and a liquid film distribution of the polishing liquid.

Figure 9:
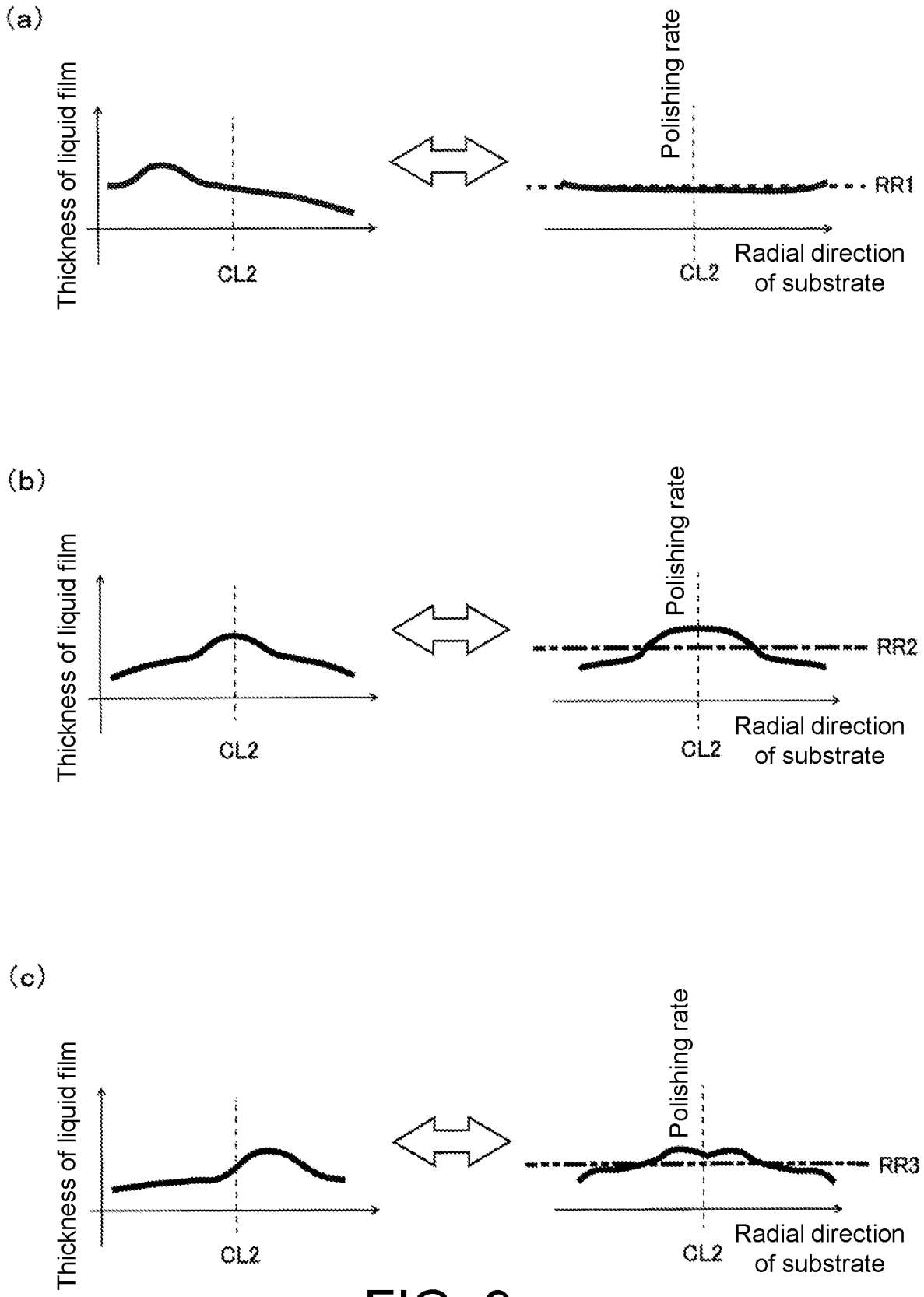

Parts (a) to (c) of FIG. 9 are diagrams showing a relationship between the liquid film distribution of the polishing liquid and a polishing rate distribution within a substrate.

Figure 10:
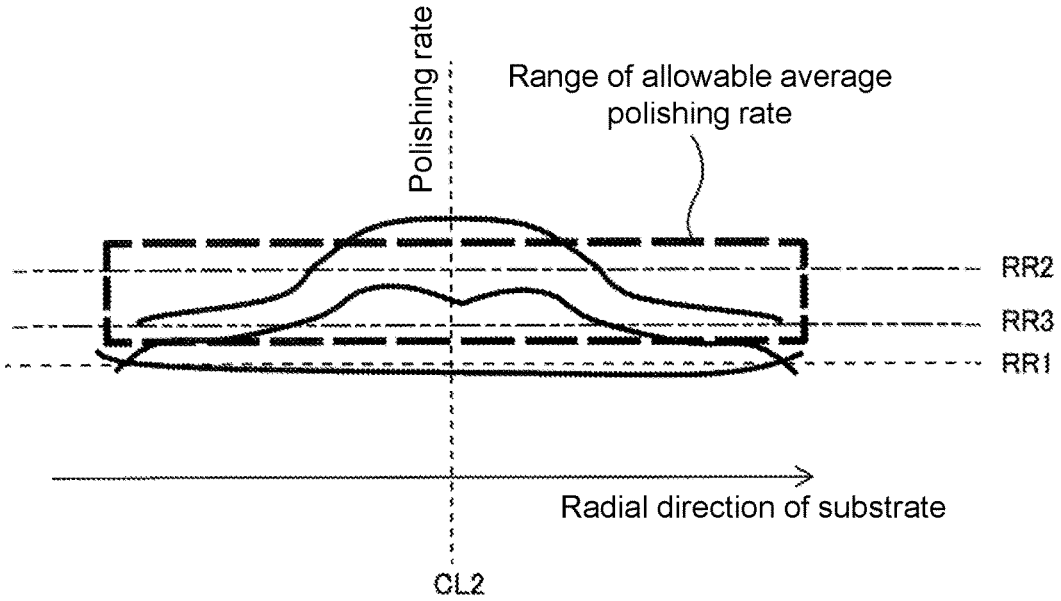

FIG. 10 is a diagram showing a range of an allowable average polishing rate.

Figure 11:
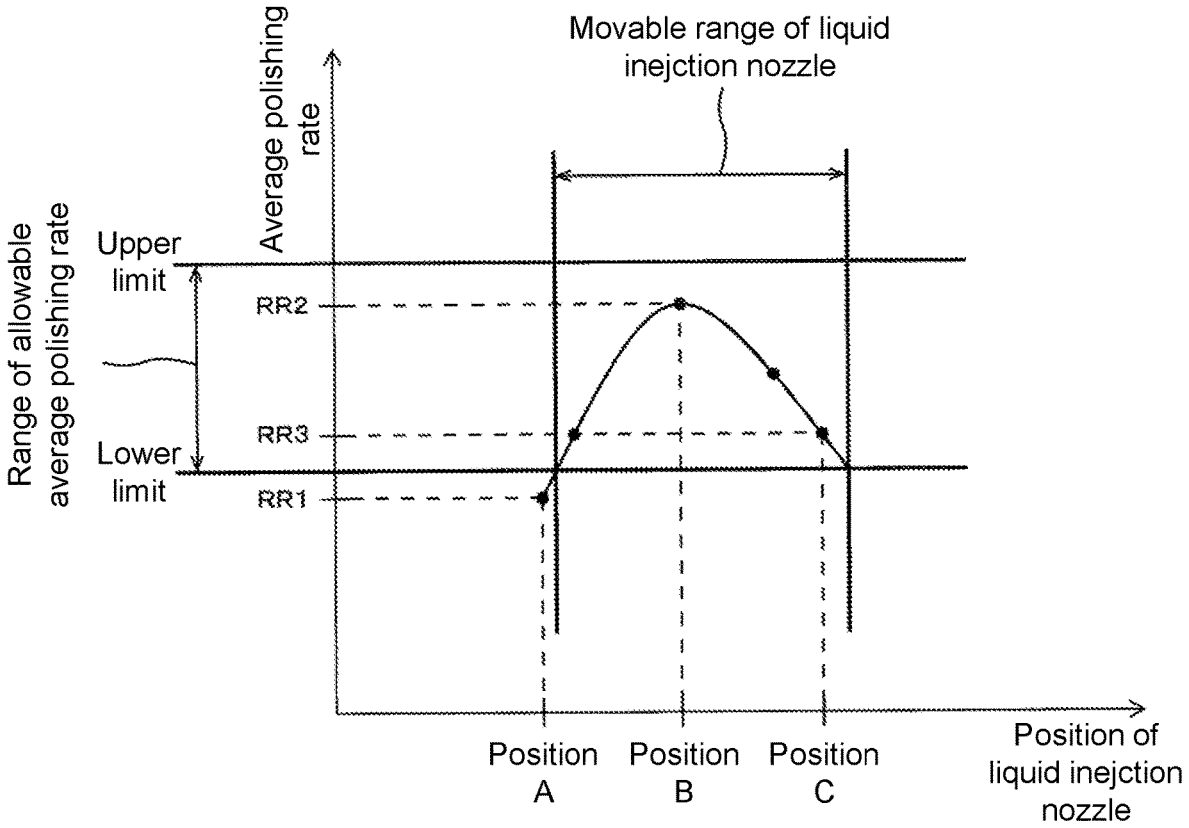

FIG. 11 is a diagram showing a relationship between the range of the allowable average polishing rate and a movable range of the liquid injection nozzle.

Figure 12:
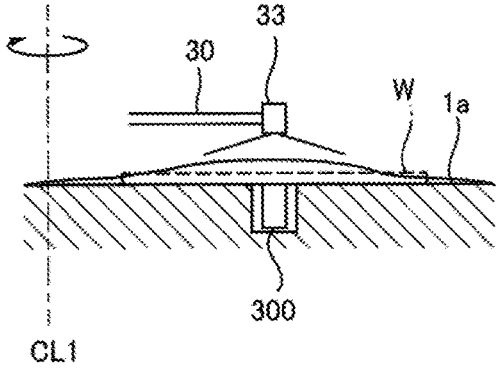
Figure 12:
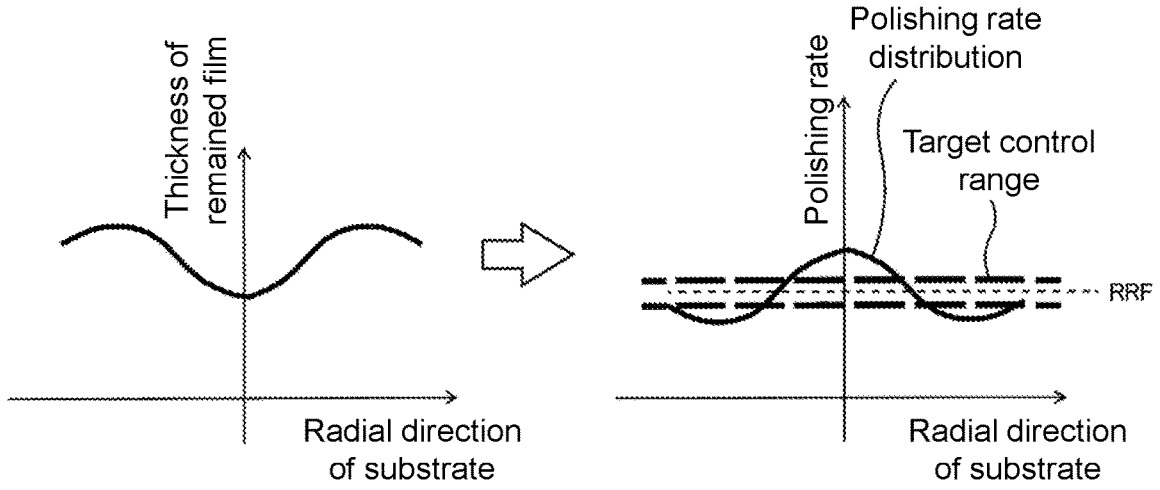

Part (a) of FIG. 12 is a diagram showing a film thickness measurement sensor and the liquid injection nozzle, and part (b) of FIG. 12 is a diagram showing an embodiment of an operation of the operation control unit during polishing of the substrate.

Figure 13:
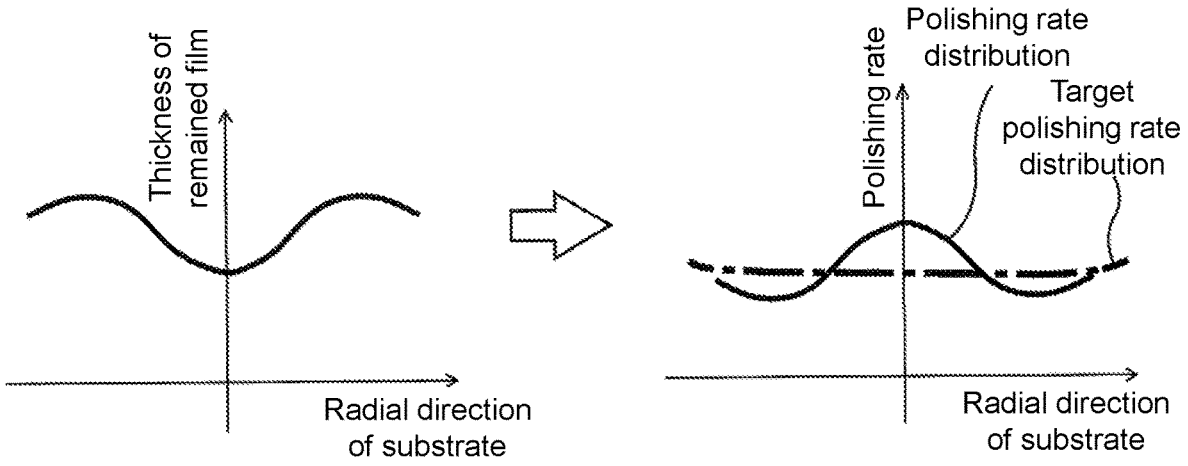

FIG. 13 is a diagram showing another embodiment of an operation of the operation control unit during polishing of the substrate.

Figure 14:
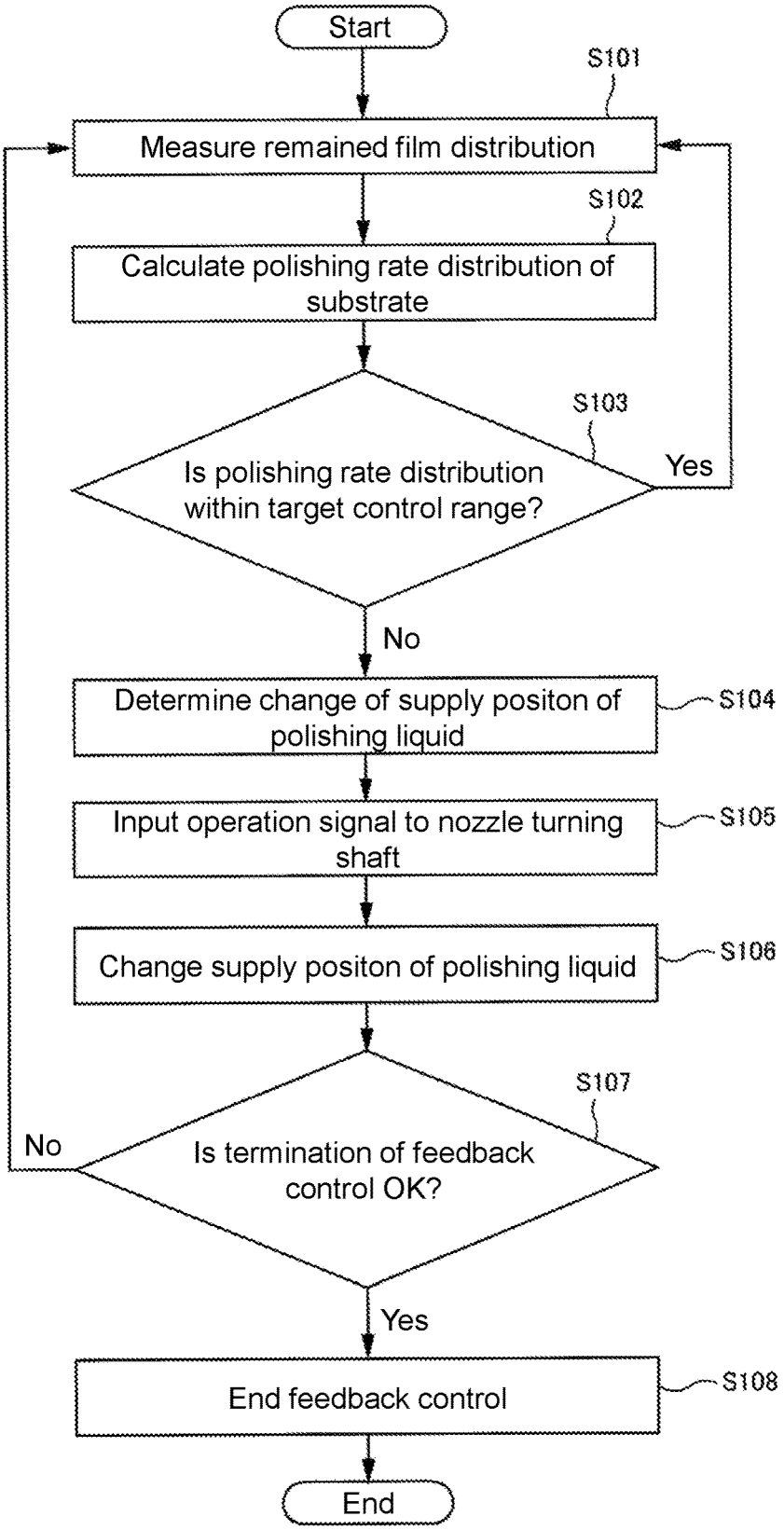

FIG. 14 is a flowchart showing an operational flow of the operation control unit.

DESCRIPTION OF THE EMBODIMENTS

The disclosure provides a polishing device and a polishing method in which a liquid injection nozzle can be moved to make distribution in supply positions of a polishing liquid uniform and to adjust the supply positions of the polishing liquid to correspond to a target polishing amount (a target control range or a target polishing rate distribution) during polishing, thereby improving uniformity of a polishing rate within a substrate. The disclosure provides a recording medium for recoding a program which can command the liquid injection nozzle to move to adjust the supply positions of the polishing liquid to correspond to the target polishing amount (the target control range or the target polishing rate distribution) during polishing, thereby improving uniformity of the polishing rate within the substrate.

According to one aspect of the embodiment, the polishing device includes a film thickness measurement sensor which measures a film thickness within the substrate, and the program includes commands of: measuring a remained film thickness distribution within the substrate using the film thickness measurement sensor; determining distribution of a target polishing amount on the basis of a difference between the measured remained film distribution and a predetermined target remained film distribution; determining the optimal supply position of the polishing liquid within the determined movable range of the liquid injection nozzle from the target polishing amount distribution and the correlation between the supply position of the polishing liquid and the distribution of the polishing rate within the substrate; and moving the liquid injection nozzle to the determined supply position.

According to one aspect of the embodiment, the program includes commands of: obtaining a polishing rate distribution during actual polishing from a change with a lapse of time of the measured remained film distribution; and determining a target control range corresponding to the target polishing amount on the basis of the polishing rate distribution during the actual polishing.

According to one aspect of the embodiment, the program obtains the polishing rate distribution during the actual polishing from the change with the lapse of time of the measured remained film distribution, and determines the target polishing rate distribution corresponding to the target polishing amount on the basis of the polishing rate distribution during the actual polishing.

According to one aspect of the embodiment, the polishing method includes measuring a remained film thickness distribution within the substrate using a film thickness measurement sensor which measures a film thickness within the substrate, determining a target polishing amount distribution on the basis of a difference between the measured remained film distribution and a predetermined target film distribution, determining the optimal supply position of the polishing liquid within the determined movable range of the liquid injection nozzle from the target polishing amount distribution and the correlation between the supply position of the polishing liquid and the distribution of the polishing rate within the substrate, and moving the liquid injection nozzle to the determined supply position.

According to one aspect of the embodiment, the polishing method includes obtaining the polishing rate distribution during actual polishing from a change with a lapse of time of the measured remained film distribution, and determining a target control range corresponding to the target polishing amount distribution on the basis of the polishing rate distribution during the actual polishing.

According to one aspect of the embodiment, the polishing method includes obtaining the polishing rate distribution during the actual polishing from the change with the lapse of time of the measured remained film distribution, and determining the target polishing rate distribution corresponding to the target polishing amount on the basis of the polishing rate distribution during the actual polishing.

According to one aspect of the embodiment, the program includes steps of: measuring a remained film thickness distribution within the substrate using a film thickness measurement sensor which measures a film thickness within the substrate; determining a target polishing amount distribution on the basis of a difference between the measured remained film distribution and a predetermined target remained film distribution; determining the optimal supply position of the polishing liquid within the determined movable range of the liquid injection nozzle from the target polishing amount distribution and the correlation between the supply position of the polishing liquid and the distribution of the polishing rate within the substrate; and moving the liquid injection nozzle to the determined supply position.

According to one aspect of the embodiment, the program includes steps of: obtaining the polishing rate distribution during actual polishing from a change with a lapse of time of the measured remained film distribution; and determining a target control range corresponding to the target polishing amount distribution on the basis of the polishing rate distribution during the actual polishing.

According to one aspect of the embodiment, the program includes steps of: obtaining the polishing rate distribution during the actual polishing from the change with the lapse of time of the measured remained film distribution; and determining the target polishing rate distribution corresponding to the target polishing amount on the basis of the polishing rate distribution during the actual polishing.

According to one reference example, a polishing device is provided. The polishing device includes a polishing pad, a top ring which presses a substrate against the polishing pad to polish the substrate, a liquid injection nozzle which injects a polishing liquid in a fan shape on the polishing pad, a nozzle moving device which moves the liquid injection nozzle in a radial direction of the polishing pad, and an operation control unit which controls an operation of the nozzle moving device. The operation control unit includes a storage device which stores a program, and a processing device which performs a calculation in accordance with the program. The program obtains a correlation between a supply position of the polishing liquid in the radial direction of the polishing pad using the liquid injection nozzle and an average polishing rate of the substrate and an distribution of the polishing rate within the substrate, determines a movable range of the liquid injection nozzle on the basis of a predetermined range of an allowable average polishing rate and the correlation between the supply position of the polishing liquid and the average polishing rate, determines an optimal supply position of the polishing liquid from the correlation between the supply position of the polishing liquid and the distribution of the polishing rate within the substrate within the determined movable range of the liquid injection nozzle, and causes the operation control unit to perform an operation of moving the liquid injection nozzle to the determined supply position to polish the substrate.

The operation control unit moves the liquid injection nozzle which injects the polishing liquid over a wide region to the supply position of the polishing liquid determined from the correlation between the supply position of the polishing liquid and the distribution of the polishing rate within the substrate within the determined movable range of the liquid injection nozzle. Therefore, the operation control unit can adjust the supply position of the polishing liquid to be optimally arranged with respect to the target polishing amount (target control range or target polishing rate distribution), thereby improving uniformity of the polishing rate within the substrate.

Hereinafter, embodiments of the disclosure will be described with reference to the drawings. Also, in the figures described below, the same or corresponding components are denoted by the same reference signs, and repeated descriptions thereof will be omitted.

FIG. 1 is a plan view of one embodiment of a polishing device PA. As shown in FIG. 1, the polishing device PA includes a polishing table 2 which supports a polishing pad 1, a top ring (a polishing head) 3 which presses a substrate W such as a wafer against the polishing pad 1, and a liquid supply mechanism 4 which supplies a liquid to the polishing pad 1. The liquid supplied from the liquid supply mechanism 4 onto the polishing pad 1 is a polishing liquid (slurry) or pure water (deionized water (DIW)).

The polishing table 2 is connected to a table motor (not shown), which rotates the polishing table 2, via a table shaft (not shown) that supports the polishing table 2. The polishing pad 1 is affixed to an upper surface of the polishing table 2, and an upper surface of the polishing pad 1 constitutes a polishing surface 1*a* that polishes the substrate W.

The top ring 3 is fixed to a lower end of a top ring shaft (not shown). The top ring 3 is configured such that the substrate W can be held by vacuum suction on a lower surface thereof. The top ring shaft is connected to a rotation mechanism (not shown) installed in a top ring arm 8. The top ring 3 is rotated by the rotation mechanism via the top ring shaft.

The top ring arm 8 is connected to a top ring swing shaft 9 which swings the top ring arm 8. The top ring swing shaft 9 is disposed outside the polishing pad 1. The top ring 3, the top ring arm 8, and the top ring swing shaft 9 constitute a top ring device 5.

The polishing device PA further includes a dressing device 10 for dressing the polishing pad 1. The dressing device 10 includes a dresser 15 brought into sliding contact with the polishing surface 1*a* of the polishing pad 1, a dresser arm 11 supporting the dresser 15, and a dresser swing shaft 12 which swings the dresser arm 11. The dresser swing shaft 12 is disposed outside the polishing pad 1.

The dresser 15 swings on the polishing surface 1*a* with rotation of the dresser arm 11. A lower surface of the dresser 15 constitutes a dressing surface configured of many abrasive such as diamond particles. The dresser 15 rotates while swinging on the polishing surface 1*a* and dresses the polishing surface 1*a* by slightly scraping off the polishing pad 1. During dressing of the polishing pad 1, the liquid supply mechanism 4 (more specifically, a dressing liquid supply device 60) supplies pure water onto the polishing surface 1*a* of the polishing pad 1. Details of a configuration of the liquid supply mechanism 4 will be described later.

The polishing device PA further includes an atomizer 20 which sprays a mist-like cleaning fluid onto the polishing surface 1*a* of the polishing pad 1 to clean the polishing surface 1*a*. The cleaning fluid is configured of a mixed fluid of a liquid (usually pure water) and a gas (for example, an inert gas such as nitrogen gas). The atomizer 20 extends in a radial direction of the polishing pad 1 (or the polishing table 2) and is positioned above the polishing surface 1*a* of the polishing pad 1. The atomizer 20 removes polishing debris and abrasive contained in the polishing liquid from the polishing surface 1*a* of the polishing pad 1 by injecting a high-pressure cleaning fluid onto the polishing surface 1*a*.

Hereinafter, a configuration of the liquid supply mechanism 4 will be described with reference to the drawings. Part (a) of FIG. 2 is a diagram viewed in a direction of line A of FIG. 1, and part (b) of FIG. 2 is a diagram showing a state in which a dirt prevention cover of part (a) of FIG. 2 is removed.

The liquid supply mechanism 4 includes a nozzle arm 30 which is movable in the radial direction of the polishing table 2, a first slurry nozzle 31 and a second slurry nozzle 32 which are disposed at a tip part 30*a* of the nozzle arm 30, and a liquid injection nozzle 33 which is disposed on an arm part 30*b* of the nozzle arm 30.

The nozzle arm 30 is connected to a nozzle moving device 35 which moves the nozzle arm 30 (see FIG. 1). In the present embodiment, the nozzle moving device 35 is configured to swing the nozzle arm 30. Therefore, the nozzle moving device 35 may be referred to as a nozzle swing shaft. In one embodiment, the nozzle moving device 35 may be configured to linearly reciprocate the nozzle arm 30 in the radial direction of the polishing pad 1. The nozzle moving device 35 is disposed outside the polishing pad 1. The nozzle arm 30 is configured to be movable between a retracted position outside the polishing pad 1 and a processing position above the polishing pad 1 by driving the nozzle moving device 35 (more specifically, a motor connected to the nozzle moving device 35).

As shown in part (a) of FIG. 2, when the nozzle arm 30 is at the processing position, the tip part 30*a* of the nozzle arm 30 is disposed above a center CL of the polishing pad 1. Therefore, the first slurry nozzle 31 and the second slurry nozzle 32 disposed at the tip part 30*a* of the nozzle arm 30 are arranged above the center CL of the polishing pad 1 to cause an injection port of the first slurry nozzle 31 and an injection port of the second slurry nozzle 32 to face the center CL of the polishing pad 1.

When the nozzle arm 30 is at the processing position, the liquid injection nozzle 33 is disposed above a region between the center CL of the polishing pad 1 and an outer circumferential part 1*b* of the polishing pad 1 so that the injection ports face the region.

In one embodiment, the liquid injection nozzle 33 is made of a resin. As an example of a material of the liquid injection nozzle 33, polytetrafluoroethylene (PTFE), polyvinyl chloride (PVC), or polypropylene (PP) can be exemplified.

The liquid injection nozzle 33 supplies a slurry A, the first slurry nozzle 31 supplies a slurry B, and the second slurry nozzle 32 supplies a slurry C. The slurry A, the slurry B, and the slurry C are different types of liquids.

Part (a) of FIG. 3 is a diagram viewed in a direction of line B of part (a) of FIG. 2, and part (b) of FIG. 3 is a diagram viewed in a direction of line C of part (a) of FIG. 2. As shown in part (a) of FIG. 3, the first slurry nozzle (first liquid nozzle) 31 and the second slurry nozzle (second liquid nozzle) 32 are disposed adjacent to each other. The first slurry nozzle 31 is connected to a first slurry line (a first liquid supply line) 40 in which a flow path through which the slurry B flows is formed, and the second slurry nozzle 32 is connected to a second slurry line (a second liquid supply line) 41 in which a flow path through which the slurry C flows is formed. The first slurry line 40 and the second slurry line 41 are disposed inside the nozzle arm 30.

As shown in part (b) of FIG. 2, the liquid injection nozzle 33 is attached to a nozzle holder 45 extending downward from the nozzle arm 30. The nozzle holder 45 is fixed to the nozzle arm 30. In the present embodiment, as shown in part (a) of FIG. 2, the nozzle holder 45 is covered with the dirt prevention cover 44, thereby preventing foreign matters from adhering to the nozzle holder 45 and a connecting member 48.

As shown in part (a) of FIG. 2, the liquid injection nozzle 33 is disposed closer to the polishing surface 1*a* of the polishing pad 1 than the first slurry nozzle 31 and the second slurry nozzle 32. That is, a distance between the polishing surface 1*a* of the polishing pad 1 and the liquid injection nozzle 33 is smaller than a distance between the polishing surface 1*a* of the polishing pad 1 and the first slurry nozzle 31 and the second slurry nozzle 32.

The liquid injection nozzle 33 is inclined toward the outer circumferential part 1*b* (that is, away from the center CL of the polishing pad 1) of the polishing pad 1 with respect a vertical direction. In one embodiment, an inclination angle of the liquid injection nozzle 33 is 13 degrees.

FIG. 4 is a diagram showing a third slurry line (a third liquid supply line) 46 and a flushing line 47 which are connected to the liquid injection nozzle 33. As shown in FIG. 4, the liquid injection nozzle 33 is connected to the third slurry line 46 in which a flow path through which the slurry A flows is formed. The connecting member 48 is connected to a midway part of the third slurry line 46, and the flushing line 47 in which a flow path through which pure water flows is formed is connected to the connecting member 48. The connecting member 48 is provided at a junction part of the flushing line 47 and the third slurry line 46.

In a direction in which the slurry A flows, an upstream side of the connecting member 48 may be referred to as an upstream flow path of the third slurry line 46, and a downstream side of the connecting member 48 may be referred to as a downstream flow path of the third slurry line 46.

The connecting member 48 is disposed adjacent to the liquid injection nozzle 33. Pure water flowing through the flushing line 47 and a tip part of the third slurry line 46 (in other words, the downstream flow path of the third slurry line 46) is injected from the liquid injection nozzle 33. The liquid (slurry A or pure water) flowing through any one of the third slurry line 46 and the flushing line 47 is injected from the liquid injection nozzle 33.

The pure water flowing through the flushing line 47 passes through the tip part of the third slurry line 46 and the liquid injection nozzle 33 and is injected to the outside. This pure water is a flushing liquid for cleaning the tip part of the third slurry line 46 and the liquid injection nozzle 33. The pure water vigorously flows inside the liquid injection nozzle 33 as the flushing liquid and instantaneously removes the slurry remaining at the tip part of the third slurry line 46 and inside the liquid injection nozzle 33. As a result, adhesion of the slurry inside the tip part of the third slurry line 46 and inside the liquid injection nozzle 33 is prevented.

The connecting member 48 is disposed adjacent to the liquid injection nozzle 33 at a position close to a slurry injection position. With such an arrangement, the polishing device PA can minimize an amount of replacing the slurry with pure water (that is, a slurry replacement amount) and maintain a throughput of the polishing device PA (the number of processed substrates W).

FIG. 5 is a cross-sectional view showing the liquid injection nozzle 33. As shown in FIG. 5, the liquid injection nozzle 33 is a fan-shaped nozzle that injects a liquid in a fan shape. The liquid injection nozzle 33 has a liquid passage surface 34*a*, a liquid injection surface 34*b*, and a liquid throttle surface 34*c* formed on an inner surface 34 thereof.

The liquid throttle surface 34*c* is disposed between the liquid passage surface 34*a* and the liquid injection surface 34*b*. The liquid throttle surface 34*c* is connected to the liquid passage surface 34*a* and the liquid injection surface 34*b*, and has a tapered shape. More specifically, the liquid throttle surface 34*c* has a shape in which an inner diameter of the liquid injection nozzle 33 gradually decreases from the liquid passage surface 34*a* toward the liquid injection surface 34*b*.

When the liquid injection nozzle 33 is a fan-shaped nozzle, there is a possibility that the slurry containing fine abrasive may adhere to the inside of the liquid injection nozzle 33. In the present embodiment, the liquid injection nozzle 33 has the tapered liquid throttle surface 34*c* formed on the inner surface 34 thereof. Therefore, the slurry inside the liquid injection nozzle 33 flows smoothly on the liquid throttle surface 34*c* without remaining on the liquid throttle surface 34*c*. In this way, staying of the slurry inside the liquid injection nozzle 33 is prevented. As a result, adhesion of the slurry inside the liquid injection nozzle 33 is prevented.

FIG. 6 is a diagram showing an injection range of the slurry A. As shown in FIG. 6, in the present embodiment, the slurry A injected from the liquid injection nozzle 33 is supplied in a fan shape onto the polishing surface 1*a* of the polishing pad 1. The slurry A is injected to a region which includes the center CL of the polishing pad 1 and is located inward from the outer circumferential part 1*b* of the polishing pad 1. In one embodiment, the injection angle of the liquid injection nozzle 33 (in other words, an angle of the slurry A injected from the liquid injection nozzle 33) is in a range from 50 degrees to 150 degrees.

According to the present embodiment, the liquid injection nozzle 33 can inject a small amount of slurry over a wide range. Therefore, an amount of slurry used can be reduced, and a polishing rate of the substrate with respect to the amount of slurry used can be improved.

As shown in FIG. 1, the polishing device PA includes an operation control unit 200 that controls operation of the liquid supply mechanism 4 (more specifically, the nozzle moving device 35). The operation control unit 200 is electrically connected to the nozzle moving device 35. The operation control unit 200 operates the nozzle moving device 35 to move the liquid injection nozzle 33 in the radial direction of the polishing pad 1. In this way, the operation control unit 200 can change a supply position of the polishing liquid. Further, as shown in FIG. 1, the operation control unit 200 is also electrically connected to the top ring swing shaft 9 and the dresser swing shaft 12 and controls operations of the top ring swing shaft 9 and the dresser swing shaft 12.

Operation of the polishing device PA including the nozzle moving device 35 is controlled by the operation control unit 200. In the present embodiment, the operation control unit 200 is configured of a computer. FIG. 7 is a schematic diagram showing a configuration of the operation control unit 200. The operation control unit 200 includes a storage device 210 in which programs, data, or the like are stored, a processing device 220 such as a central processing unit (CPU) or a graphic processing unit (GPU) which performs calculations in accordance with the programs stored in the storage device 210, an input device 230 for inputting data, programs, and various pieces of information to the storage device 210, an output device 240 for outputting processed results or processed data, and a communication device 250 for connection to a communication network such as the Internet or a local area network.

The storage device 210 includes a main storage device 211 that can be accessed by the processing device 220 and an auxiliary storage device 212 that stores data and programs. The main storage device 211 is, for example, a random access memory (RAM), and the auxiliary storage device 212 is a storage device such as a hard disk drive (HDD) or a solid state drive (SSD).

The input device 230 includes a keyboard and a mouse, and further includes a recording medium reading device 232 for reading data from a recording medium and a recording medium port 234 to which the recording medium is connected. The recording medium is a computer-readable recording medium that is a non-transitory tangible medium, for example, such as an optical disk (for example, a CD-ROM, a DVD-ROM, or the like) or a semiconductor memory (for example, a USB flash drive, a memory card, or the like). Examples of the recording medium reading device 232 include an optical drive such as a CD-ROM drive and a DVD-ROM drive, and a memory reader. An example of the recording medium port 234 is a USB port. The programs and/or data stored in the recording medium are introduced into the operation control unit 200 via the input device 230 and are stored in the auxiliary storage device 212 of the storage device 210. The output device 240 includes a display device 241 and a printing device 242.

Parts (a) to (c) of FIG. 8 are diagrams showing a relationship between a supply position of the polishing liquid and a liquid film distribution of the polishing liquid. Parts (a) to (c) of FIG. 9 are diagrams showing a relationship between the liquid film distribution of the polishing liquid and a polishing rate within the substrate. Reference sign CL1 represents a center line of the polishing pad 1 passing through the center CL of the polishing pad 1 (see FIG. 1), and reference sign CL2 represents a center line of the substrate W passing through a center of the substrate W.

As shown in part (a) of FIG. 8, when the polishing liquid is injected in a state in which the liquid injection nozzle 33 is disposed at a position closer to the center line CL1 of the polishing pad 1 than the center line CL2 of the substrate W, a liquid film of the polishing liquid on a center side of the polishing pad 1 becomes thicker. Hereinafter, in the present specification, a position of the liquid injection nozzle 33 on the center side of the polishing pad 1 may be referred to as a position A as shown in part (a) of FIG. 8.

As shown in part (b) of FIG. 8, when the polishing liquid is injected in a state in which the liquid injection nozzle 33 is disposed on the center line CL2 of the substrate W, a liquid film of the polishing liquid at the center of the substrate W becomes thicker. Hereinafter, in the present specification, a position of the liquid injection nozzle 33 above the center of the substrate W may be referred to as a position B as shown in part (b) of FIG. 8.

As shown in part (c) of FIG. 8, when the polishing liquid is injected in a state in which the liquid injection nozzle 33 is disposed on the outer circumferential part 1*b* (see FIG. 1) side of the polishing pad 1 with respect to the center line CL2 of the substrate W, a liquid film of the polishing liquid outside the center line CL2 of the substrate W becomes thicker. Hereinafter, in the present specification, as shown in part (c) of FIG. 8, a position of the liquid injection nozzle 33 on the outer circumferential part 1*b* side of the polishing pad 1 may be referred to as a position C.

In Parts (a) to (c) of FIG. 9, reference signs RR1, RR2, and RR3 each represent an average polishing rate of the substrate W. The average polishing rate RR1 is lower than the average polishing rate RR3, and the average polishing rate RR3 is lower than the average polishing rate RR2 (RR2>RR3>RR1).

As shown in part (a) of FIG. 9, when the polishing liquid is injected in a state in which the liquid injection nozzle 33 is disposed at a position on the center side of the polishing pad 1, distribution of the polishing rate within the substrate W is substantially uniform. As shown in part (b) of FIG. 9, when the polishing liquid is injected in a state in which the liquid injection nozzle 33 is disposed at a position above the center of the substrate W, the polishing rate of the substrate W increases at the center position of the substrate W. As shown in part (c) of FIG. 9, when the polishing liquid is injected in a state in which the liquid injection nozzle 33 is disposed at a position on the outer circumferential part 1*b* side of the polishing pad 1, the polishing rate of the substrate W decreases at the position of the center of the substrate and increases at the position around the center of the substrate. Thus, the polishing rate distribution within the substrate W varies depending on the position at which the polishing liquid is supplied.

As shown in Parts (a) to (c) of FIG. 8 and Parts (a) to (c) of FIG. 9, there is a correlation between the supply position of the polishing liquid in the radial direction of the polishing pad 1 (that is, the substrate W) using the liquid injection nozzle 33 and the average polishing rate of the substrate W and an distribution of the polishing rate within the substrate.

The operation control unit 200 obtains the correlation in advance and stores data indicating the correlation in the storage device 210 as a database.

The operation control unit 200 including a computer operates in accordance with a program electrically stored in the storage device 210. That is, the operation control unit 200 is configured to determine a movable range of the liquid injection nozzle 33 on the basis of the correlation stored in the storage device 210 and a predetermined range of an allowable average polishing rate, and to move the liquid injection nozzle 33 within the determined movable range of the liquid injection nozzle 33 to polish the substrate W.

The program for causing the operation control unit 200 to execute these steps is recorded on the computer-readable recording medium that is a non-temporary tangible medium and is provided to the operation control unit 200 via the recording medium. Alternatively, the program may be input from the communication device 250 to the operation control unit 200 via the communication network such as the Internet or a local area network.

FIG. 10 is a diagram showing a range of the allowable average polishing rate. As described above, the operation control unit 200 determines the movable range of the liquid injection nozzle 33 on the basis of data (see a region surrounded by a dotted line in FIG. 10) indicating the correlation and the predetermined range of the allowable average polishing rate stored in the storage device 210. The range of the allowable average polishing rate is stored in advance in the storage device 210 of the operation control unit 200 as an input parameter. Although the average polishing rate of the substrate W varies depending on the supply position of the polishing liquid in the radial direction using the liquid injection nozzle 33, the average polishing rate may greatly increase or decrease depending on the supply position, and these changes in the polishing rate affect a processing speed of the substrate W, cleaning performance of the substrate W after polishing, and the like. Therefore, it is desirable that the average polishing rate according to the supply position of the liquid injection nozzle 33 be within a certain allowable range, and the allowable average polishing rate is set for that purpose.

The range of the allowable average polishing rate is set to include a desired average polishing rate in accordance with polishing conditions of the substrate W. According to the example of FIG. 10, the average polishing rate RR2 and the average polishing rate RR3 are included in the range of the allowable average polishing rate, but the average polishing rate RR1 is not included in the range of the allowable average polishing rate. Therefore, the operation control unit 200 moves the liquid injection nozzle 33 within a range from the position B above the center of the substrate W (see part (b) of FIG. 8) to the position C on the outer circumferential part 1*b* side of the polishing pad 1 (see part (c) of FIG. 8). Also, as an example of the allowable average polishing rate, an upper limit and a lower limit thereof may be a percentage (for example, ±10%) or a difference value (for example, ±100 A/min) with respect to the desired average polishing rate.

FIG. 11 is a diagram illustrating a relationship between the range of the allowable average polishing rate and the movable range of the liquid injection nozzle 33. As shown in FIG. 11, the operation control unit 200 determines the range of the allowable average polishing rate to include the average polishing rate RR2 and the average polishing rate RR3. The operation control unit 200 determines the movable range of the liquid injection nozzle 33 to include the position B and the position C of the liquid injection nozzle 33.

Part (a) of FIG. 12 is a diagram showing a film thickness measurement sensor 300 and the liquid injection nozzle 33, and part (b) of FIG. 12 is a diagram showing an embodiment of an operation of the operation control unit 200 during polishing of the substrate W. As shown in part (a) of FIG. 12, the polishing device PA includes the film thickness measurement sensor 300 embedded in the polishing pad 1 (and the polishing table 2). The film thickness measurement sensor 300 is a sensor for measuring a film thickness of the substrate W. An example of the film thickness measurement sensor 300 includes an eddy current sensor or an optical sensor.

The eddy current sensor is a sensor that detects a linkage magnetic flux formed by eddy current of the substrate W and detects a thickness of a processing target film of the substrate W (that is, a remained film distribution of the processing target film) on the basis of the detected linkage magnetic flux. The optical sensor is a sensor that irradiates the substrate W with light and measures interference waves reflected from the substrate W to detect a thickness of a processing target film (that is, a remained film distribution of the processing target film).

The film thickness measurement sensor 300 is electrically connected to the operation control unit 200 and sends sensor data (sensor signals) having a correlation with the film thickness of the substrate W to the operation control unit 200. When the sensor data from the film thickness measurement sensor 300 is input to the operation control unit 200, the operation control unit 200 converts the sensor data into a film thickness value of the substrate W. In addition, the film thickness measurement sensor 300 may be used to detect a polishing end point and to end the polishing performed by the polishing device PA in accordance with a predetermined setting.

When the polishing device PA starts polishing the substrate W, the operation control unit 200 measures the remained film distribution of the processing target film of the substrate W using the film thickness measurement sensor 300, and obtains a polishing amount distribution on the basis of a change with a lapse of time of the measured remained film distribution. Then, the operation control unit 200 determines a target polishing amount from a difference from a predetermined target film distribution. The operation control unit 200 determines an optimal supply position of the polishing liquid within the movable range of the liquid injection nozzle 33 from the correlation between the supply position of the polishing liquid 210 and the distribution of the polishing rate within the substrate stored in the storage device with respect to the determined target polishing amount, and moves the liquid injection nozzle 33 to a determined supply position.

More specifically, as shown in part (b) of FIG. 12, the operation control unit 200 obtains a polishing rate distribution within the substrate W from the change with the lapse of time of the remained film distribution measured by the film thickness measurement sensor 300 (see a solid line in part (b) of FIG. 12). The polishing rate distribution is distribution in the radial direction of the substrate W. The operation control unit 200 obtains an average polishing rate RRF during actual polishing from the polishing rate distribution within the substrate W, and determines a target control range (see thick dotted lines in part (b) of FIG. 12) corresponding to a target polishing amount on the basis of the average polishing rate RRF. The target control range is determined by a predetermined ratio to the average polishing rate RRF. The target control range is a range having a predetermined width including the average polishing rate RRF.

FIG. 13 is a diagram illustrating another embodiment of the operation of the operation control unit 200 during polishing of the substrate W. In the embodiment illustrated in part (b) of FIG. 12, the operation control unit 200 determines the target control range. As shown in FIG. 13, the operation control unit 200 may obtain the polishing rate distribution during actual polishing (see a solid line in FIG. 13) from the change with the lapse of time of the remained film distribution measured by the film thickness measurement sensor 300, and may determine a target polishing rate distribution (see a dashed line in FIG. 13) on the basis of the above polishing rate. The target polishing rate distribution corresponds to distribution of the target polishing amount mentioned above.

In one embodiment, the operation control unit 200 may determine the target control range related to the remained film of the substrate W on the basis of the measured remained film distribution. In one embodiment, the operation control unit 200 may determine the target film distribution related to the remained film of the substrate W on the basis of the measured remained film distribution. Each of the target control range and the target film distribution corresponds to the target polishing amount distribution.

FIG. 14 is a flowchart showing an operational flow of the operation control unit 200. After the polishing of the substrate W is started, the operation control unit 200 measures the remained film distribution within the substrate W (more specifically, the processing target film) and monitors a state of the remained film of the substrate W on the basis of the sensor data detected by the film thickness measurement sensor 300 (see step S101 in FIG. 14). Next, the operation control unit 200 calculates the polishing rate distribution within the substrate W on the basis of the change with the lapse of time of the measured remained film distribution (see step S102 in FIG. 14).

Thereafter, the operation control unit 200 determines whether or not the calculated polishing rate distribution is within the target control range (see step S103 in FIG. 14). In one embodiment, the operation control unit 200 may make the determination on the basis of the target polishing rate distribution. At least one of the target control range and the target polishing rate distribution is stored in the storage device 210 of the operation control unit 200.

When the polishing rate distribution is within the target control range (see "YES" in step S103 in FIG. 14), the operation control unit 200 returns to step S101 in FIG. 14 and continues monitoring the remained film distribution. When the polishing rate distribution is not within the target control range, that is, when the polishing rate distribution is outside the target control range (see "NO" in step S103 in FIG. 14), the operation control unit 200 determines to change the supply position of the polishing liquid within the movable range of the liquid injection nozzle 33 (see step S104 in FIG. 14).

The change of the supply position of the polishing liquid is determined as follows. For example, when a part of the polishing rate in the radial direction of the substrate W is larger (or smaller) than the target control range (or target polishing rate distribution), the operation control unit 200 moves the liquid injection nozzle 33 within the movable range of the liquid injection nozzle 33 to reduce (or increase) the part of the polishing rate on the basis of data indicating the correlation between the supply position of the polishing liquid and the polishing rate distribution within the substrate W.

When a plurality of parts of the polishing rate in the radial direction of the substrate W are larger (or smaller) than the target control range (or the target polishing rate distribution), the operation control unit 200 moves the liquid injection nozzle 33 within the movable range of the liquid injection nozzle 33 so that the largest part of the polishing rate (or the smallest part of the polishing rate) is minimized (or maximized).

As described above, the operation control unit 200 determines an extreme value (maximum value or minimum value) of the polishing rate on the basis of a deviation amount of the polishing rate from the target control range (or the target polishing rate distribution), and changes the supply position of the polishing liquid so that the extreme value varies.

When a remained film thickness of the processing target film of the substrate W is extremely small, the remained film thickness cannot be further reduced. Accordingly, the operation control unit 200 changes the supply position of the polishing liquid so that the part having the smallest polishing rate is maximized.

After step S104 in FIG. 14, the operation control unit 200 inputs an operation signal necessary for operating the nozzle moving device 35 to the nozzle moving device 35 (see step S105 in FIG. 14). The operation control unit 200 operates the nozzle moving device 35 to change the supply position of the polishing liquid (see step S106 in FIG. 14). As described above, the operation control unit 200 changes a position of the liquid injection nozzle 33 on the basis of the comparison between a current polishing rate distribution and the target control range (or the target polishing rate distribution), and executes feedback control so that the polishing rate distribution within the substrate W during polishing falls within the target control range.

After step S106 in FIG. 14, the operation control unit 200 determines whether or not the feedback control may be terminated (see step S107 in FIG. 14). If the operation control unit 200 does not permit the termination of the feedback control (see "NO" in step S107 in FIG. 14), the operation control unit 200 returns to step S101 in FIG. 14 and continues to monitor the remained film distribution. When the operation control unit 200 allows the termination of the feedback control (see "YES" in step S107 in FIG. 14), the operation control unit 200 ends the feedback control (see step S108 in FIG. 14). Thereafter, the operation control unit 200 ends the polishing of the substrate W.

Data related to the feedback control (associated data) is input to the storage device 210 of the operation control unit 200 as information necessary for generating a polishing recipe (including conditions for polishing the substrate W). The polishing device PA polishes the substrate W in accordance with the polishing recipe. The associated data includes elements as described below.

When the operation control unit 200 determines the target polishing amount on the basis of the change with the lapse of time of the remained film distribution measured by the film thickness measurement sensor 300, the associated data may include the target film distribution within the substrate W and/or a sensor signal corresponding to the remained film.

The associated data may include a correlation between the position of the liquid injection nozzle 33 (that is, the supply position of the polishing liquid) and the polishing rate distribution within the substrate W, and the movable range of the liquid injection nozzle 33 determined on the basis of the correlation. The associated data may include the target control range for the polishing rate.

Since a polishing state is not stable immediately after the polishing device PA starts polishing the substrate W, the operation control unit 200 may not be able to obtain accurate data worth performing the feedback control. Therefore, the associated data includes a time (start time) at which the operation control unit 200 starts the feedback control. The start time is a time for determining how many seconds after the start of the polishing of the substrate W the feedback control is to be started.

The associated data may include a feedback cycle for performing the feedback control. In one embodiment, the feedback cycle may be determined on the basis of the rotation of the polishing table 2 or time. The associated data may include an effective time of the feedback control. In one embodiment, the effective time may be any time equal to or less than the polishing time of the substrate W, or may be determined on the basis of the remained film of the substrate W.

According to the present embodiment, the liquid injection nozzle 33 is configured to inject the polishing liquid in a fan shape over a wide area, unlike a single pipe nozzle that locally supplies a polishing liquid. Therefore, there is no variation in distribution of supply positions of the polishing liquid. Further, since the operation control unit 200 does not need to swing the liquid injection nozzle 33, the distribution of the supply positions of the polishing liquid in the radial direction of the substrate W becomes uniform in the circumferential direction of the polishing pad 1. As a result, a decrease in the polishing rate of the substrate W can be inhibited.

The operation control unit 200 controls the position of the liquid injection nozzle 33 that injects the polishing liquid. Therefore, the use of the liquid injection nozzle 33 enables a wide flow rate distribution of the polishing liquid without swinging the nozzle unlike a single tube nozzle. Further, the operation control unit 200 moves the liquid injection nozzle 33 within the movable range of the liquid injection nozzle 33 determined on the basis of the range of the allowable average polishing rate. Therefore, the operation control unit 200 can improve uniformity of the polishing rate within the substrate W.

The polishing rate of the substrate W can vary depending not only on the supply positions of the polishing liquid, but also on the flow rate (supply amount) of the polishing liquid supplied onto the polishing pad 1. Therefore, there is also a correlation between the supply amount of the polishing liquid and the polishing rate distribution within the substrate W, and the operation control unit 200 may control the flow rate of the polishing liquid together with the supply positions.

In one embodiment, the operation control unit 200 may obtain the correlation in advance and store data indicating the correlation in the storage device 210 as a database. The associated data may include data indicating the correlation. In this case, the operation control unit 200 may change the supply position of the polishing liquid and change the supply amount of the polishing liquid within the movable range of the liquid injection nozzle 33. More specifically, the operation control unit 200 operates a flow rate adjusting device (not shown) attached to the third slurry line 46 (see FIG. 4) to adjust the supply amount of the polishing liquid.

The polishing rate of the substrate W can vary depending not only on the supply position of the polishing liquid but also on a pressing force of the substrate W against the polishing surface 1*a*. Therefore, there is a correlation between the pressing force of the substrate W against the polishing surface 1*a* and the polishing rate distribution within the substrate W, and the pressing force of the substrate W may be controlled by the operation control unit 200 together with the supply position.

In one embodiment, the operation control unit 200 may obtain the correlation in advance and store data indicating the correlation in the storage device 210 as a database. The associated data may include data indicating the correlation. In this case, the operation control unit 200 may change the supply position of the polishing liquid within the movable range of the liquid injection nozzle 33 and may change the pressing force of the substrate W against the polishing surface 1*a*. This pressing force changes on the basis of the flow rate of the fluid supplied to a plurality of pressure chambers formed by elastic films (membranes) provided on the top ring 3. Therefore, the operation control unit 200 operates the flow rate adjusting device (not shown) to adjust the flow rate of the fluid supplied to the pressure chambers to be pressurized.

In the present embodiment, the liquid injection nozzle 33 is a nozzle that injects the polishing liquid in a fan shape. Therefore, when the liquid injection nozzle 33 is inclined with respect to the polishing surface 1*a* of the polishing pad 1 (see FIG. 6), the amount of the polishing liquid injected onto the substrate W is not uniform in the radial direction of the substrate W. Therefore, the polishing rate of the substrate W can vary depending not only on the supply position of the polishing liquid but also on the inclination angle of the liquid injection nozzle 33 with respect to the polishing surface 1*a*. Therefore, there is a correlation between the inclination angle of the liquid injection nozzle 33 and the polishing rate distribution within the substrate W, and the inclination angle of the liquid injection nozzle 33 may be controlled by the operation control unit 200 in conjunction with the supply position.

In one embodiment, the operation control unit 200 may obtain the correlation in advance and store data indicating the correlation in the storage device 210 as a database. The associated data may include data indicating the correlation. In this case, the operation control unit 200 may change the supply position of the polishing liquid within the movable range of the liquid injection nozzle 33 and may change the inclination angle of the liquid injection nozzle 33. More specifically, the operation control unit 200 may change the inclination angle of the liquid injection nozzle 33 using an actuator (for example, a motor) that adjusts the inclination angle of the liquid injection nozzle 33.

The above embodiments have been described for the purpose of enabling a person having ordinary knowledge in the technical field to which the disclosure pertains to carry out the disclosure. Various modifications of the above embodiment can be naturally made by those skilled in the art, and the technical idea of the disclosure can be applied to other embodiments. Accordingly, the disclosure is not limited to the embodiments described, but is to be accorded the widest scope consistent with the spirit as defined by the appended claims. It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A polishing device comprising:

a polishing pad;

a top ring which presses a substrate against the polishing pad to polish the substrate;

a liquid injection nozzle which injects a polishing liquid in a fan shape on the polishing pad;

a nozzle moving device which moves the liquid injection nozzle in a radial direction of the polishing pad; and an operation control unit configured to control an operation of the nozzle moving device, wherein the operation control unit comprises a storage device which stores instructions, which when executed by a processing device, causes the processing device to:

obtain a correlation between a supply position of the polishing liquid in the radial direction of the polishing pad using the liquid injection nozzle and an average polishing rate of the substrate and an distribution of a polishing rate within the substrate;

determine a movable range of the liquid injection nozzle according to a predetermined range of an allowable average polishing rate and the correlation between the supply position of the polishing liquid and the average polishing rate, wherein the movable range of the liquid injection nozzle is determined according to supply positions of the liquid injection nozzle whose average polishing rates are within the predetermined range of the allowable average polishing rate;

determine an optimal supply position of the polishing liquid from the correlation between the supply position of the polishing liquid and the distribution of the polishing rate within the substrate within the determined movable range of the liquid injection nozzle; and cause the nozzle moving device to move the liquid injection nozzle to the determined supply position to polish the substrate.

2. The polishing device according to claim 1, further comprising a film thickness measurement sensor which measures a film thickness within the substrate, including a remained film distribution within the substrate, wherein the instructions, which when executed by the processing device, cause the processing device to:

receive the remained film distribution within the substrate from the film thickness measurement sensor;

determine distribution of a target polishing amount according to a difference between the measured remained film distribution and a predetermined target film distribution;

determine the optimal supply position of the polishing liquid within the determined movable range of the liquid injection nozzle from the target polishing amount distribution and the correlation between the supply position of the polishing liquid and the distribution of the polishing rate within the substrate; and cause the nozzle moving device to move the liquid injection nozzle to the determined supply position.

3. The polishing device according to claim 2, wherein the instructions causes the processing device to:

obtain a polishing rate distribution during actual polishing from a change with a lapse of time of the measured remained film distribution; and determine a target control range corresponding to the target polishing amount according to the polishing rate distribution during the actual polishing.

4. The polishing device according to claim 2, wherein the instructions causes the processing device to obtain a polishing rate distribution during actual polishing from a change with a lapse of time of the measured remained film distribution, and determine a target polishing rate distribution corresponding to the target polishing amount according to the polishing rate distribution during the actual polishing.

5. A polishing method comprising:

obtaining a correlation between a supply position of a polishing liquid in a radial direction of a polishing pad using a liquid injection nozzle which injects the polishing liquid onto the polishing pad in a fan shape and an average polishing rate of a substrate and an distribution of a polishing rate within the substrate;

determining a movable range of the liquid injection nozzle from a predetermined range of an allowable average polishing rate and the correlation between the supply position of the polishing liquid and the average polishing rate, wherein the movable range of the liquid injection nozzle is determined according to supply positions of the liquid injection nozzle whose average polishing rates are within the predetermined range of the allowable average polishing rate;

determining an optimal supply position of the polishing liquid from the correlation between the supply position of the polishing liquid and the distribution of the polishing rate within the substrate within the determined movable range of the liquid injection nozzle; and cause a nozzle moving device to move the liquid injection nozzle to the determined supply position to polish the substrate.

6. The polishing method according to claim 5, further comprising:

measuring a remained film distribution within the substrate using a film thickness measurement sensor which measures a film thickness within the substrate;

determining a target polishing amount distribution according to a difference between the measured remained film distribution and a predetermined target film distribution;

determining the optimal supply position of the polishing liquid within the determined movable range of the liquid injection nozzle from the target polishing amount distribution and the correlation between the supply position of the polishing liquid and the distribution of the polishing rate within the substrate; and controlling a nozzle moving device to move the liquid injection nozzle to the determined supply position.

7. The polishing method according to claim 6, further comprising:

obtaining a polishing rate distribution during actual polishing from a change with a lapse of time of the measured remained film distribution; and determining a target control range corresponding to the target polishing amount distribution according to the polishing rate distribution during the actual polishing.

8. The polishing method according to claim 6, further comprising:

obtaining a polishing rate distribution during actual polishing from a change with a lapse of time of the measured remained film distribution; and determining a target polishing rate distribution corresponding to the target polishing amount according to the polishing rate distribution during the actual polishing.

9. A non-transitory computer-readable recording medium storing instructions, which when executed by a computer, cause the computer to:

obtain a correlation between a supply position of a polishing liquid in a radial direction of a polishing pad using a liquid injection nozzle which injects the polishing liquid onto the polishing pad in a fan shape and an average polishing rate of a substrate and an distribution of a polishing rate within the substrate;

determine a movable range of the liquid injection nozzle from a predetermined range of an allowable average polishing rate and the correlation between the supply position of the polishing liquid and the average polishing rate, wherein the movable range of the liquid injection nozzle is determined according to supply positions of the liquid injection nozzle whose average polishing rates are within the predetermined range of the allowable average polishing rate;

determine an optimal supply position of the polishing liquid from the correlation between the supply position of the polishing liquid and the distribution of the polishing rate within the substrate within the determined movable range of the liquid injection nozzle; and cause a nozzle moving device to move the liquid injection nozzle to the determined supply position to polish the substrate.

10. The recording medium according to claim 9, wherein the instructions, which when executed by the computer, cause the computer to:

receive a remained film distribution within the substrate from a film thickness measurement sensor which measures a film thickness within the substrate;

determine a target polishing amount distribution according to a difference between the measured remained film distribution and a predetermined target film distribution;

determine the optimal supply position of the polishing liquid within the determined movable range of the liquid injection nozzle from the target polishing amount distribution and the correlation between the supply position of the polishing liquid and the distribution of the polishing rate within the substrate; and cause a nozzle moving device to move the liquid injection nozzle to the determined supply position.

11. The recording medium according to claim 10, wherein instructions cause the computer to:

obtain a polishing rate distribution during actual polishing from a change with a lapse of time of the measured remained film distribution; and determine a target control range corresponding to the target polishing amount distribution according to the polishing rate distribution during the actual polishing.

12. The recording medium according to claim 10, wherein the instructions cause the computer to:

obtain a polishing rate distribution during actual polishing from a change with a lapse of time of the measured remained film distribution; and determine a target polishing rate distribution corresponding to the target polishing amount according to the polishing rate distribution during the actual polishing.

* * * * *